US005348626A

United States Patent [19]

Miller et al.

[11] Patent Number: 5,348,626

[45] Date of Patent: Sep. 20, 1994

[54] ELECTROLYTIC RECOVERY OF REACTOR METAL FUEL

[75] Inventors: William E. Miller, Naperville; Zygmunt Tomczuk, Lockport, both of Ill.

[73] Assignee: The United States of America as represented by the United States Department of Energy, Washington, D.C.

[21] Appl. No.: 12,713

[22] Filed: Feb. 3, 1993

[51] Int. Cl.[5] ..... C25C 3/34; G21C 19/42

[52] U.S. Cl. ..... 204/1.5; 204/64 R; 204/243 R; 205/230

[58] Field of Search ..... 204/1.5, 64 R, 243 R; 205/230

[56] References Cited

U.S. PATENT DOCUMENTS

| | | | |
|---|---|---|---|
| 4,582,584 | 4/1986 | Josefowicz | 204/243 R |
| 4,814,046 | 3/1989 | Johnson et al. | 204/1.5 |
| 4,880,506 | 11/1989 | Ackerman et al. | 204/1.5 |
| 5,009,752 | 4/1991 | Tomczuk et al. | 204/64 R |
| 5,141,723 | 8/1992 | Miller et al. | 423/5 |
| 5,147,616 | 9/1992 | Ackerman et al. | 423/5 |
| 5,160,367 | 11/1992 | Pierce et al. | 75/397 |

*Primary Examiner*—John Niebling
*Assistant Examiner*—William T. Leader
*Attorney, Agent, or Firm*—Bradley W. Smith; Hugh Glenn; William R. Moser

[57] ABSTRACT

A new electrolytic process and apparatus are provided using sodium, cerium or a similar metal in alloy or within a sodium beta or beta''-alumina sodium ion conductor to electrolytically displace each of the spent fuel metals except for cesium and strontium on a selective basis from the electrolyte to an inert metal cathode. Each of the metals can be deposited separately. An electrolytic transfer of spent fuel into the electrolyte includes a sodium or cerium salt in the electrolyte with sodium or cerium alloy being deposited on the cathode during the transfer of the metals from the spent fuel. The cathode with the deposit of sodium or cerium alloy is then chanted to an anode and the reverse transfer is carried out on a selective basis with each metal being deposited separately at the cathode. The result is that the sodium or cerium needed for the process is regenerated in the first step and no additional source of these reactants is required.

16 Claims, 1 Drawing Sheet

ELECTROLYTIC RECOVERY OF REACTOR METAL FUEL

CONTRACTUAL ORIGIN OF THE INVENTION

The United States Government has rights in this invention pursuant to Contract No. W-31-109-ENG-38 between the U.S. Government and Argonne National Laboratories.

BACKGROUND OF THE INVENTION

1. Field of the Invention

This invention relates to the electrolytic processing of spent metal fuel from reactors, such as the Integral Fast Reactor (IFR) and similar reactors, and more particularly to the process and apparatus for electrolytic separation of reactor metal fuel and/or radioactive waste metals from spent metal fuel.

2. Description of the Prior Art

For the IFR, the electrorefining process for spent metal fuel involves the electrolytic transfer of uranium, plutonium, certain actinides, rare earths and other waste metals from the fuel into a molten salt electrolyte. Subsequently, uranium and plutonium are electrolytically transferred to a cathode which may be changed to accommodate the deposition of each metal. The salt electrolyte is periodically treated to remove most of the remaining metals. Both the electrorefining and salt treatment are complex processes with the salt treatment requiring a number of process steps.

The IFR process has spent electrorefiner salt which contains $PuCl_3$. Chloride salts also exist in the defense complex waste which contain $PuCl_3$. It is desirable that the plutonium be removed from these wastes, not only to recover the Pu but also to create a more acceptable waste form. Research in this area described below could be beneficial to the IFR process and also the defense complex.

An object of the invention is to provide a method for the selective separation of the metal fuel and/or waste metals using less complex techniques compared to those for the electrorefining or waste treatment.

It is another object of the invention to provide simple electrolytic processes for separating plutonium from the spent reactor metal fuel or waste salts, for example produced in the weapons program.

It is another object of the invention to provide a process for electrolytic separation of reactor metal fuel and/or radioactive waste metals from spent metal fuel overcoming some of the disadvantages of known arrangements for electrorefining processes for spent metal fuel and waste treatment.

SUMMARY OF THE INVENTION

In brief, these and other objects and advantages of the invention are provided by a new electrolytic process and apparatus using sodium, cerium, or a similar metal in an alloy or within a beta-alumina sodium ion conductor to electrolytically displace each of the metals except for cesium and strontium on a selective basis from the electrolyte to the cathode. The displacement would extend beyond uranium and plutonium to the other actinides, the rare earths, and certain alkali and alkaline earth metals. Each of the metals can be deposited separately and can be processed or combined with other metals as required to fabricate fresh metal fuels or waste metal repositories without the complexity or cost associated with the present procedures.

A feature of the invention includes a modification of the electrolytic transfer of spent fuel into the electrolyte by including a sodium or cerium salt in the electrolyte with sodium or cerium being deposited on the cathode during the transfer of the metals from the spent fuel. The cathode with the deposit of sodium or cerium is then changed to an anode and the reverse transfer is carried out on a selective basis with each metal being deposited separately. The result is that the sodium or cerium needed for the process is regenerated in the first step and no additional source of these reactants is required. It should also be noted that the invention essentially includes both the electrorefining and waste treatment processes.

BRIEF DESCRIPTION OF THE DRAWING

These and other objects and advantages of the present invention will become readily apparent upon consideration of the following detailed description and attached drawing, wherein.

DETAILED DESCRIPTION OF THE PREFERRED EMBODIMENT

Figure 1:
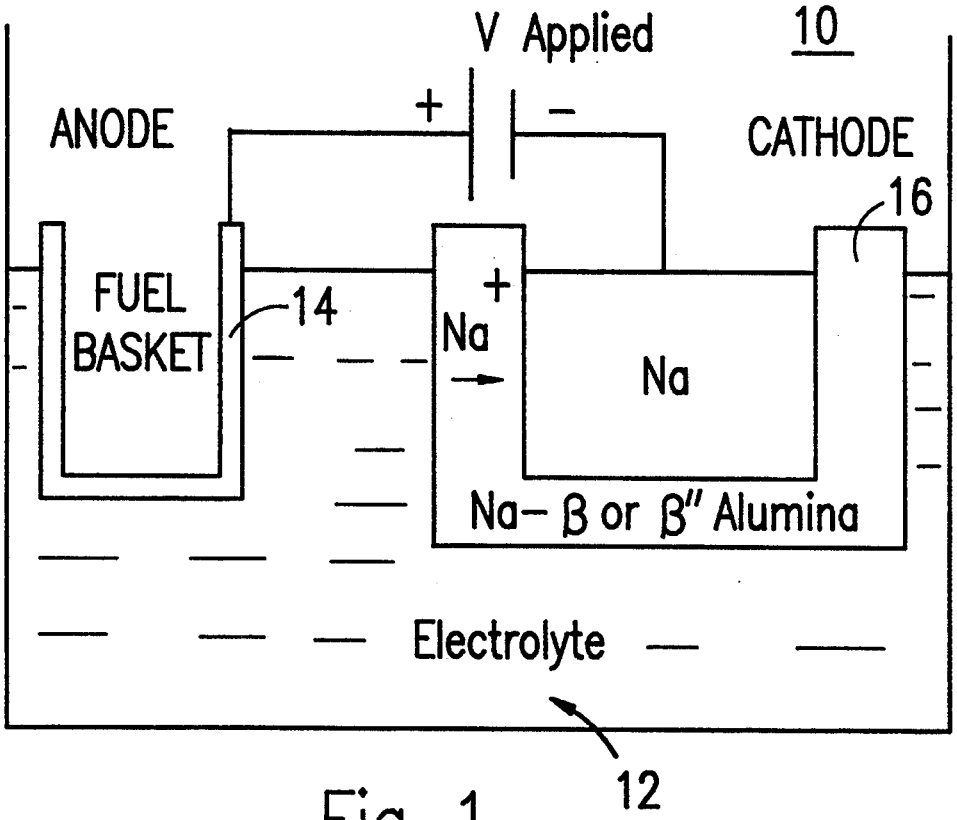
FIG. 1 is a schematic representation of an electrolytic cell during an anodic dissolution step of the invention using a fuel basket anode and sodium metal in a sodium ion conductor, sodium $\beta$ or sodium $\beta''$-alumina cathode.

Consider waste salts that contain actinides such as would be found in the spent electrorefiner salt of the IFR process which contains $PuCl_3$. and $ReCl_3$ or NaCl. One could do a reduction of the $PuCl_3$ contained in the waste salt by using the reductant Na or a rare earth, Ce for instance. For these possible reductions the free energy driving forces are:

$$3\ Na + PuCl_3 \longrightarrow 3\ NaCl + Pu$$

$$\Delta G = -53.6 \text{ kcal at } 1000^\circ \text{ K.}$$

$$Ce + PuCl_3 \longrightarrow CeCl_3 + Pu$$

$$\Delta G - 18.7 \text{ kcal at } 800^\circ \text{ K.}$$

Either one of these reductants should drive the $PuCl_3$ content of the salt to less than 1 ppm.

In accordance with the present invention, as an alternative to direct reductions, the electrochemical cells (A) and (B) can be arranged as follows:

| | Anode | 650° C.–700° | Cathode Inert Metal Surfaces |
|---|---|---|---|
| (A) | (Na Alloy) (Solid) or Na Liquid in Beta-alumina tube | Waste Salt Containing $PuCl_3$ and NaCl | Pu Liquid |
| (B) | (Ce Alloy) (Solid) | Waste Salt Containing $PuCl_3$ and $ReCl_3$ | Pu Liquid |

The type of cathode to be employed is referred to as a Los Alamos type which is a Mo metal form with a drip cup below to collect the liquid plutonium when the cell operating temperature is >650° C. For the IFR, the waste salt after drawdown of the heavy metal (U,Pu) contains:

| Salt | Mol % |
|---|---|
| $PuCl_3$ | $1.5 \times 10^{-2}$ |
| $UCl_3$ | $5.8 \times 10^{-3}$ |
| $ReCl_3$ | 0.28 |
| NaCl | 2.0 |

In addition, the waste salt contains alkali and alkaline earth, FP chlorides, and other transuranium (TRU) chlorides, such as $AmCl_3$. Either cell (A) or (B) would apply. Uranium and americium would be expected to plate out on the cathode and would be washed down by the Pu. If cell (B) were used we also might expect some Re to plate out with the Pu on the cathode.

A requirement of a solid anode alloy of Na or Ce is that the alloy is chemically stable or kinetically inhibited to spontaneous reaction with the salt. For the case of cerium, for example, an intermetallic compound of antimony whose free energy of formation is greater than the driving force for spontaneous chemical reaction with the salt can be used.

In accordance with the invention, Pu can be recovered at a cathode in an electrolytic cell by displacing Pu in $PuCl_3$ with either Ce or Na. The Ce or Na would be used in the cell as an anode and could be an alloy of these metals. The alloy would reduce the activity of the active metals Ce or Na, so that spontaneous reaction with the salt would not occur. For the case when sodium is to be used as an anode, when the sodium metal is contained in the sodium ion conductor, beta or beta"-alumina, then alloying of the sodium would not be necessary. Sodium beta or beta"-alumina can be used as a cathode in the first stage and as an anode in the second or reverse stage to process metal fuel. A beta-alumina tube for the second stage could include a plunger or rod to be inserted as the sodium is consumed to maintain the required level of contact in the beta-alumina during the process.

Figure 2:
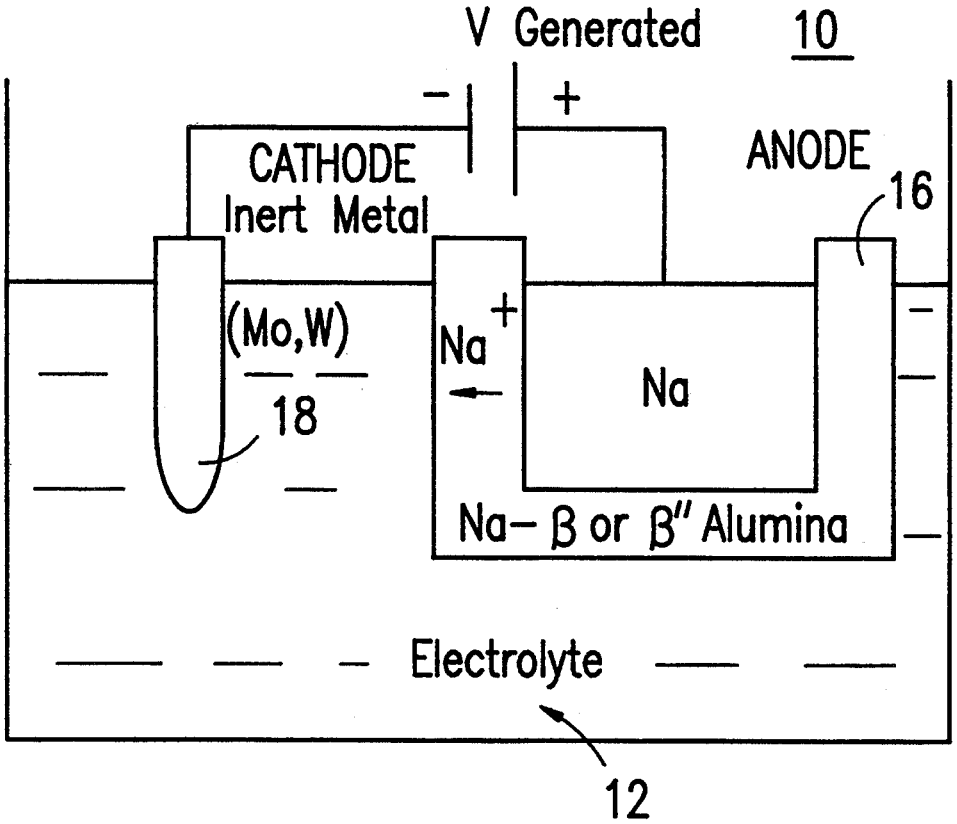
FIG. 2 is a schematic representation of the electrolytic cell during a deposition step of the invention using the sodium ion conductor electrode, sodium $\beta$ or sodium $\beta''$-alumina serving as an anode with an inserted inert (Mo, W) metal surface as a cathode electrode.

The process of the invention may be understood with reference to the following tables 1 and 2 and the schematical cell configuration shown in FIGS. 1 and 2.

In FIG. 1 there is shown an electrolytic cell, generally designated by reference character 10, for carrying out an anodic dissolution step of the process of the invention. Initially, an electrolyte 12 contains LiCl, KCl, NaCl, CsCl and $SrCl_2$. Electrolyte 12 contacts a fuel basket anode 14 containing, for example, active fission products (FP), U, Pu, Actinides, Zr and Noble Metal fission products (NMFP) and a sodium ion conductor, sodium $\beta$-alumina cathode. The following Table 1 provides an illustrative example of an anodic dissolution step of the invention:

TABLE 1

| Anode | Electrolyte Process Salt | Cathode |
|---|---|---|
| | Start of Anodic Dissolution | |
| Fuel Basket Active FP, U, Pu, Actinides, Zr, NMFP | LiCl—KCl—NaCl— Na Cl CsCl, $SrCl_2$ | Na in (sodium beta or beta"-alumina) |
| | After Anodic Dissolution | |
| Fuel Basket | LiCl—KCl—NaCl | Na in |

TABLE 1-continued

| Anode | Electrolyte Process Salt | Cathode |
|---|---|---|
| Clad, NMFP, ZrMo, ZrRu Waste | CsCl, $SrCl_2$ $ZrCl_x$, $UCl_3$, $PuCl_3$ $AmCl_3$, $YCl_3$, $CeCl_3$ $LaCl_3$-Representative Actinides and FPs | Na beta-alumina Na |

For the anodic dissolution step the electrolytic cell 10 is driven by an external voltage $V_{APPLIED}$ estimated to be approximately −1.35 volt. The voltage would be sufficient to cause everything down through "free" Zr to oxidize. This would leave Zirconium Noble Metal (ZrNM) intermetallics and Noble Metal (NM) as waste in the anode basket, the anode basket being ferrous and not oxidized. As fuel is converted to chloride, Cs, St, and Ba in the fuel will oxidize chemically and become a permanent part of the electrolyte.

FIG. 2 illustrates the deposition step of the process of the invention with an inert metal (Mo, W) cathode electrode 18 inserted into the cell 10 and the sodium $\beta$-alumina ion cathode 16 now operating as an anode to the cathode electrode 18. The following Table 2 provides an illustrative example of a deposition step of the invention:

TABLE 2

| Anode | Electrolyte Process Salt | Cathode Inert Metal (Mo, W) Surfaces |
|---|---|---|
| | Start of the Deposition Step | |
| Na in beta-alumina Na | LiCl—KCl—NaCl CsCl, $SrCl_2$ $ZrCl_x$, $UCl_3$, $PuCl_3$ $AmCl_3$, $YCl_3$, $CeCl_3$ $LaCl_3$-Representative Actinides and FPs | |
| | After Deposition Step | |
| Na in beta-alumina | LiCl—KCl-NaCl Na Cl CsCl, $SrCl_2$ | Zr, U, Pu, Am, Y, Ce, La |

For the deposition step the cell 10 would act as a discharging battery. Then the voltage generated $V_{GENERATED}$ during this discharge is estimated to vary from +1.35 volt for discharging $Zr^{(+x)}$ to 0.44 volt for discharging $La^{+3}$. Separations at the cathode would be achieved by limiting the cell current so that the metals would plate out in the order Zr, U, Pu, Y, Ce, La, as the cell voltage drops.

The following estimate is provided for illustrative purposes and is not intended to be restrictive as to the scope of the invention. In order to understand the magnitude of the sodium electrode, an estimate has been made for processing a 10 kg heavy metal IFR (HM IFR) batch of fuel. If all but the noble metals in the spent fuel are oxidized, then we estimate that 344 gram equivalents or 7.91 kg of sodium would be required. The volume of this sodium is about 10 liters. If $\beta$-alumina tubes 2" in diameter by 24" long were used then eight tubes would be needed for the electrode. The volume change in the electrolyte would be about 12 liters, equal to less than 10% in a practical case. The total ampere-hour (A-hr) passed at 100% current efficiency would be about 9,200. If the current limit were the current density at the $\beta$-alumina surface at, for example, 0.3 AMP/cm$^2$, then the current would be 2,330 AMP and the time needed would be about 4 hours.

In brief summary, during the deposition step the Na-beta-alumina or Na-beta"-alumina is the anode 16 and the cathode collector is an inert (Mo, W) metal surface 18. During fuel dissolution a metal basket with fuel is the anode 14 and the Na-beta-alumina is the cathode 16. With this arrangement the beta-alumina electrode is a permanent part of the cell 10 and it is only necessary to switch polarity when changing from deposition to dissolution. Removal of the Na-beta-alumina electrode 16 from the cell is not required, therefore it would not be subject to thermal shock each cycle.

Obviously, many modifications and variations the present invention are possible in light of the above teachings. Thus, it is to be understood that, within the scope of the appended claims, the invention may be practiced otherwise than as specifically described above.

What is claimed and desired to be secured by Letters Patent of the United States is:

1. An electrolytic process of recovering a nuclear reactor metal fuel comprising the steps of:

providing an electrolytic cell including a fused salt electrolyte containing metal halides of the reactor metal fuel, an anode electrode and a cathode electrode in contact with the electrolyte, and said anode being an active metal capable of displacing a select group of metals from said metal halides contained in said electrolyte and with said cathode being an inert metal when in contact with said select group of metals;

operating the cell during a cathode deposition step by limiting a cell current generated during said cathode deposition to selectively deposit metals onto said cathode electrode from said metal halides in said electrolyte.

2. An electrolytic process as recited in claim 1 wherein sodium or cerium at said active metal anode electrode is used for displacing each of the metals deposited at said cathode electrode during said cathode deposition step.

3. An electrolytic process as recited in claim 1 wherein said active metal anode electrode is sodium contained in a sodium beta-alumina or sodium beta"-alumina conductor.

4. An electrolytic process as recited in claim 1 wherein said active metal anode electrode is a sodium or cerium alloy.

5. An electrolytic process as recited in claim 1 wherein said inert cathode electrode is a noble metal cathode collector.

6. An electrolytic process as recited in claim 1 wherein said inert cathode electrode includes inert metal surfaces selected from the group consisting of Mo or W.

7. An electrolytic process as recited in claim 1 wherein said step of selectively depositing metals at said cathode electrode is achieved by passing current to generate a cell voltage in a range from about +1.35 volt to +0.44 volt.

8. An electrolytic process as recited in claim 1 wherein said step of operating the cell during a cathode deposition step includes operating the cell as a discharging battery and limiting current flow, whereby the metals plate out in a predetermined order as the cell voltage drops.

9. An electrolytic process of recovering a nuclear reactor metal fuel comprising the steps of:

providing an electrolytic cell including a fused salt electrolyte, an anode electrode and a cathode electrode in contact with the electrolyte, and a source of electrical voltage to said electrodes;

operating the cell during an anodic dissolution step with a metal fuel basket containing said metal fuel being anode wherein said basket being of a metal which will not undergo oxidation during said anodic dissolution step and with an active metal alloy electrode being said cathode to transfer nuclear reactor metal fuel contained in said metal fuel basket into said electrolyte; and operating the cell during a cathode deposition step by limiting a cell current generated during said cathode deposition with said active metal alloy electrode being said anode, said active metal capable of displacing nuclear reactor metal fuel from said electrolyte, and with an inert metal cathode to selectively deposit metals from said nuclear reactor metal fuel transferred into said electrolyte at said cathode electrode, said cathode being inert when in contact with the deposited metals.

10. An electrolytic process as recited in claim 9 wherein said cathode electrode during said anodic dissolution step is a sodium $\beta$ or $\beta''$-alumina sodium ion conductor.

11. An electrolytic process as recited in claim 9 wherein said anode electrode during said cathode deposition step is a sodium $\beta$ or $\beta''$-alumina sodium ion conductor containing sodium.

12. An electrolytic process as recited in claim 9 wherein said cathode electrode during said anodic dissolution step is said anode electrode during said cathode deposition step.

13. An electrolytic process as recited in claim 9 wherein sodium or cerium at said active metal anode electrode is used for displacing each of the metals deposited at said cathode electrode during said cathode deposition step.

14. An electrolytic process as recited in claim 9 during said cathode deposition step said inert cathode electrode is an inert metal current collection electrode selected from the group consisting of MO or W.

15. An electrolytic process as recited in claim 9 wherein said step of operating the cell during said anodic dissolution step includes the step of applying an external voltage up to approximately −1.35 volt.

16. An electrolytic process as recited in claim wherein said step of operating the cell during said cathode deposition step includes the step of passing current to generate a voltage in a range between approximately +1.35 volt to 0.44 volt.

* * * * *